US009820052B2

(12) United States Patent
Mao et al.

(10) Patent No.: US 9,820,052 B2
(45) Date of Patent: Nov. 14, 2017

(54) SPEAKER

(71) Applicants: Lubin Mao, Shenzhen (CN); Cheng Zhou, Shenzhen (CN); Hongxing Wang, Shenzhen (CN)

(72) Inventors: Lubin Mao, Shenzhen (CN); Cheng Zhou, Shenzhen (CN); Hongxing Wang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/061,189

(22) Filed: Mar. 4, 2016

(65) Prior Publication Data

US 2017/0034628 A1 Feb. 2, 2017

(30) Foreign Application Priority Data

Jul. 31, 2015 (CN) ..... 2015 2 0571541 U

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 9/02*** | (2006.01) |
| *H04R 7/04* | (2006.01) |
| *H04R 9/04* | (2006.01) |
| *H04R 31/00* | (2006.01) |

(52) U.S. Cl.

CPC ..... *H04R 9/025* (2013.01); *H04R 7/04* (2013.01); *H04R 9/045* (2013.01); *H04R 9/047* (2013.01); *H04R 9/063* (2013.01); *H04R 31/006* (2013.01); *H04R 2209/022* (2013.01); *H04R 2499/11* (2013.01)

(58) Field of Classification Search

CPC ..... H04R 9/045; H04R 1/06; H04R 7/127; H04R 7/14; H04R 9/025; H04R 9/06; H04R 2499/11

USPC ..... 381/409

See application file for complete search history.

(56) References Cited

U.S. PATENT DOCUMENTS

| | | | | | |
|---|---|---|---|---|---|
| 5,701,358 | A * | 12/1997 | Larsen | H04R 9/063 | 381/400 |
| 2005/0276431 | A1* | 12/2005 | Moore | H04R 1/345 | 381/340 |
| 2010/0171376 | A1* | 7/2010 | Huang | H02K 33/18 | 310/25 |
| 2012/0177246 | A1* | 7/2012 | Shi | H01F 7/0289 | 381/398 |
| 2014/0355815 | A1* | 12/2014 | Hung | H04R 9/025 | 381/412 |
| 2015/0117699 | A1* | 4/2015 | Cai | H01F 7/0289 | 381/412 |

* cited by examiner

*Primary Examiner* — Sean H Nguyen
(74) *Attorney, Agent, or Firm* — Na Xu; IPro, PLLC

(57) ABSTRACT

A speaker is provided in the present disclosure. The speaker includes a shell, a magnetic system and a vibrating system received in the shell. The magnetic system includes a first magnet module and a second magnet module opposite to each other for forming a magnetic gap. The vibrating system includes a membrane module and a coil assembly for driving the membrane module to vibrate. The coil assembly includes a coil arranged in the magnetic gap and a coil support for supporting the coil; at least one of the first magnet module and the second magnet module includes a soft magnet unit, the soft magnet unit is arranged adjacent to the magnetic gap and faces the coil.

11 Claims, 3 Drawing Sheets

SPEAKER

FIELD OF THE DISCLOSURE

The present disclosure relates to electro-acoustic converting technologies, and more particularly, to a speaker for producing audible sound.

BACKGROUND

Speakers are widely applied in mobile devices, such as mobile phones, tablet computers, laptop computers, portable game player, portable multimedia devices, or the like, for converting electrical signals into audible sounds. A related speaker includes a vibration system, a magnetic system, and a holder for holding the vibration system and the magnetic system.

The magnetic system includes two opposite magnet module opposite to each other to form a magnetic gap. The vibrating system includes a membrane and a coil assembly connected to the membrane, the coil assembly includes a coil and a coil support for supporting the coil; the coil is located in the magnetic gap for driving the membrane to vibrate and produce sound.

In the above-described speaker, each of the first magnet module and the second magnet module normally includes several elongated magnets arranged in parallel. However, with this configuration, a magnetic field provided by the magnetic system has a non-linear characteristic, which may impact an acoustic performance of the speaker.

Therefore, it is desired to provide a new speaker which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiment thereof.

Figure 1:
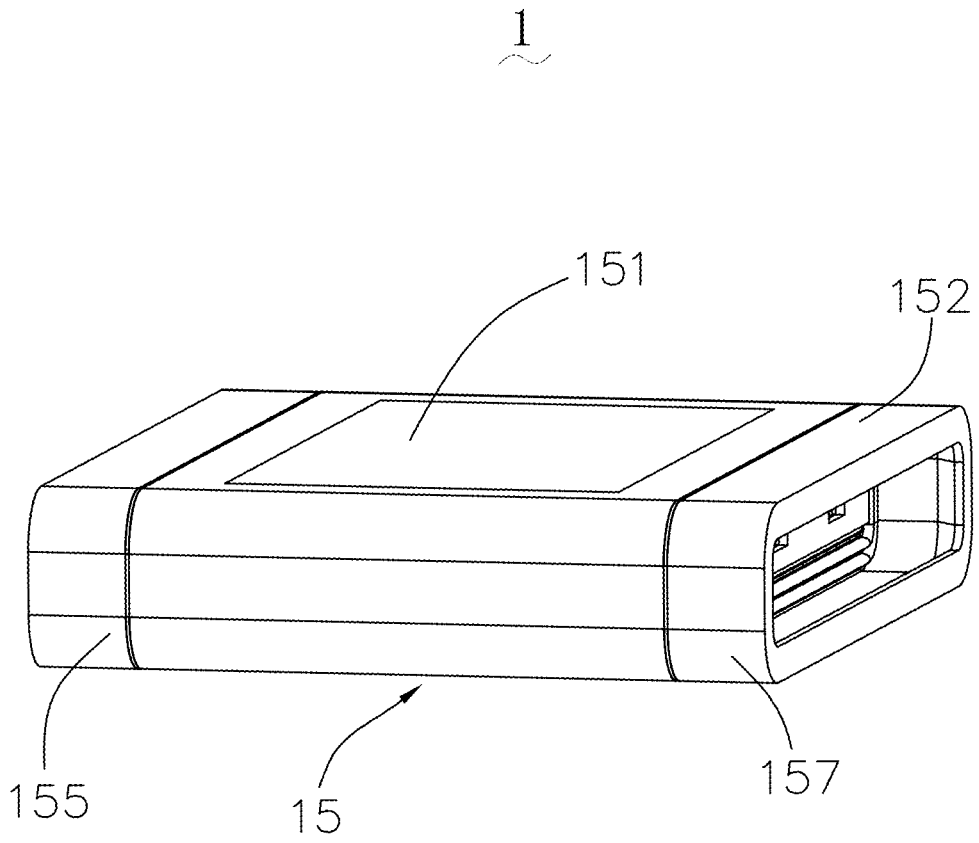
FIG. 1 is an assembled view of a speaker according to an embodiment of the present disclosure.
Figure 2:
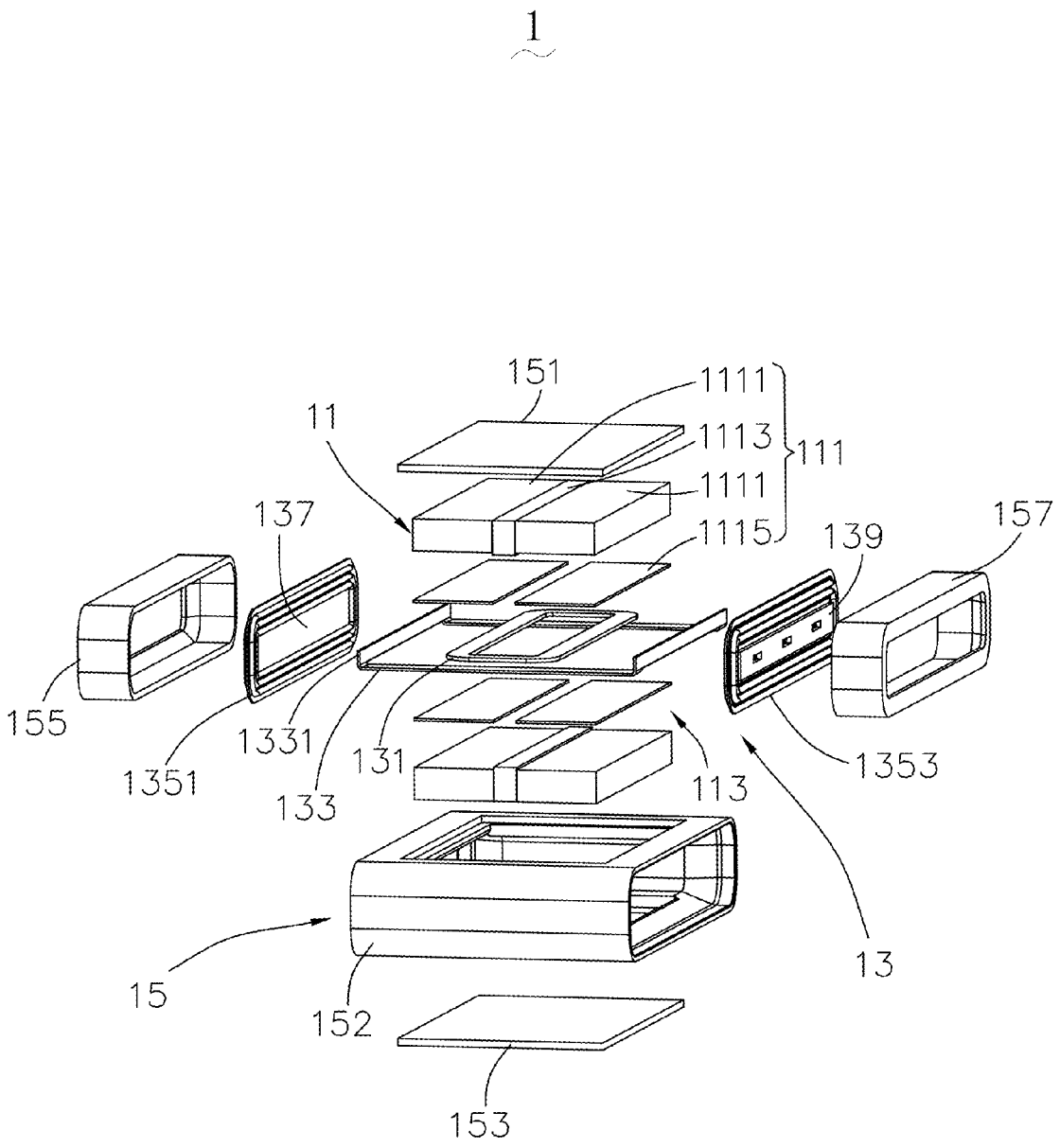
FIG. 2 is an exploded view of the speaker of FIG. 1.
Figure 3:
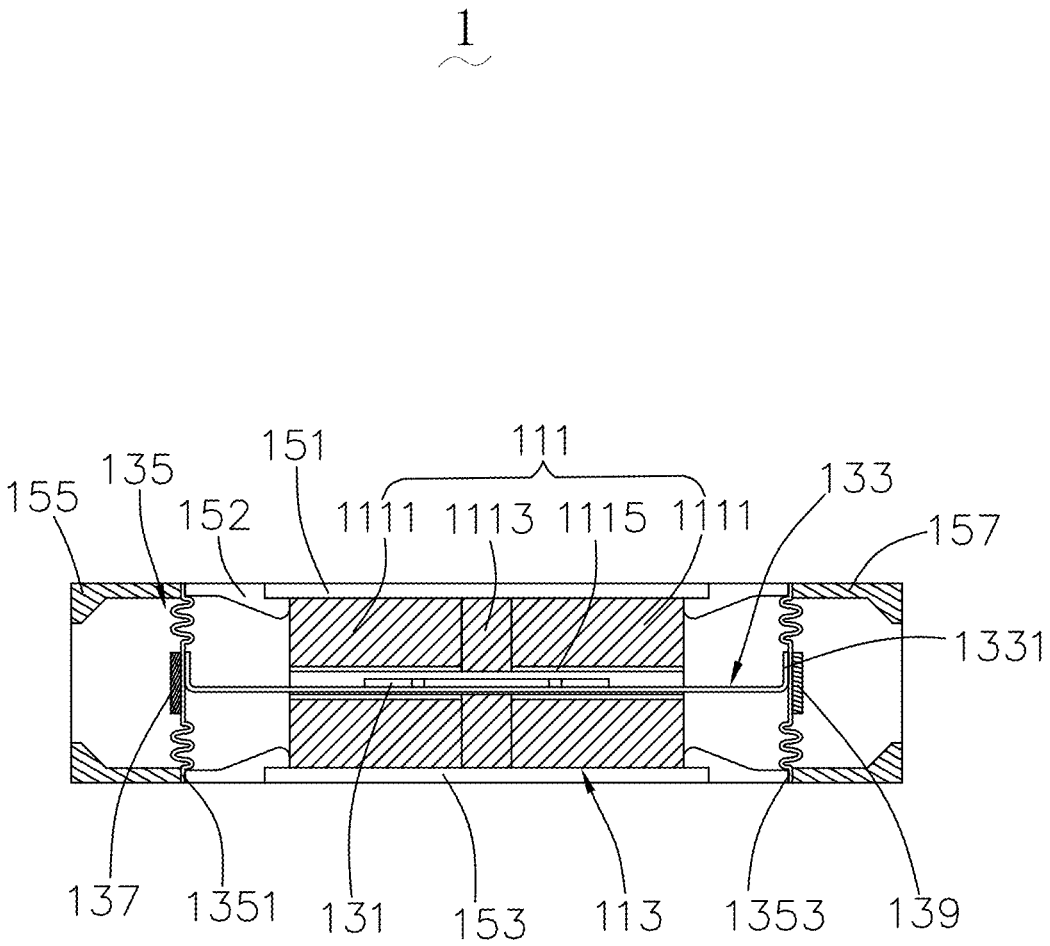
FIG. 3 is a cross-sectional view of the speaker of FIG. 1.

Referring to FIGS. 1-3, a speaker 1 according to an embodiment of the present disclosure is shown. The speaker 1 includes a magnetic system 11, a vibrating system 13 and a shell 15. The vibrating system 13 and the magnetic system 11 are accommodated in the shell 15.

Specifically, the shell 15 includes a main frame 152, a first cover plate 151, a second cover plate 153, a first cover 155 and a second cover 157. The main frame 152 provides a receiving cavity for receiving the vibrating system 13 and the magnetic system 11, and may be a hollow frame with two opposite openings. In the present embodiment, the two openings are aligned along a vibration direction of the vibrating system 13, and are defined as a front opening located at a front end of the main frame 152, and a rear opening located at a rear end of the main frame 152. The first cover 155 serves as a front cover of the speaker 1, and is engaged with the front end of the main frame 152; the second cover 157 serves as a rear cover of the speaker 1, and is engaged with the rear end of the main frame 152. In particular, at least one of the first cover 155 and the second cover 157 may include a sound outlet for outputting audible sound generated by the speaker 1, and in the present embodiment, the sound outlet is formed at in the front cover 155 and faces the first opening of the main frame 152.

The main frame 152 further includes a top opening and a bottom opening respectively from at a top plate and a bottom plate thereof; the top plate and the bottom plate are opposite to each other and perpendicular to the vibration direction of the vibrating system 13. The first cover plate 151 and the second cover plate 153 are respectively provided to cover the top opening and the bottom opening of the main frame 152. In the present embodiment, the first cover plate 151 and the second cover plate 153 are detachable from the main frame 152, which is convenient for assembly and disassembly of speaker components, including the vibrating system 13 and the magnetic system 15, inside the shell 11.

The vibrating system 13 includes a coil 131, a coil support 133, a membrane module 135, a supporting assembly 1353, a first dome 137 and a second dome 139. The membrane module 135 includes a front membrane 1351 is arranged at the front opening of the main frame 152. The supporting assembly 1353 may also be in a membrane shape which is arranged at the rear opening of the main frame 152 and opposite to the front membrane 1351. The first dome 137 is a front dome attached on a front surface of the front membrane 1351 and facing the front cover 155, and the second dome 139 is a rear dome attached on a rear surface of the supporting assembly 1353 and facing the rear cover 157.

The coil 131 and the coil support 133 cooperatively form a coil assembly, which serves as a vibration driving module for driving the membrane module 135 to vibrate and produce audible sound. The coil assembly is located in a magnetic gap provided by the magnetic system 11, and is connected between the membrane module 135 and the supporting assembly 1353. Moreover, the coil assembly is arranged in a plane perpendicular to the vibration direction of the membrane 135 and the supporting assembly 1353.

The coil 131 may be an oblate ring-shaped coil formed by a plurality of conductive wires, and is positioned in the magnetic gap of the magnetic system 11 to obtain a long stroke. The coil support 133 is configured for supporting the coil 131, and transferring motion of the coil 131 to the membrane module 135. The coil support 133 includes a main body which may be a rectangular ring-shaped plate for fixing the coil 131, and a pair of extending parts 1331 extending perpendicularly from two opposite edges of the main body respectively. The pair of extending parts 1331 is respectively connected to and abuts against the membrane module 1351 and the supporting assembly 1353 respectively.

In the present embodiment, each of the extending parts 1331 may be an elongated piece extending from the entire edge of the main body; moreover, the main body and the extending parts 1331 may be integrated into a one-piece structure to enhance an intensity of the coil support 133 and protect the coil 131 thereon from suffering undesired distortion.

Furthermore, the coil support 133 may be made of material with light and rigid characteristics; for example, the coil support 133 may be made of aluminum alloy, which can improve an electro-acoustic converting efficiency of the speaker 1 as well as a rigidity of the coil support 133 to ensure stability of the coil 131. In other embodiments, the material of the coil support may alternatively be any one selected from magnesium alloy, stainless steel, plastic, and carbon fiber composite.

The front membrane 1351 includes a first flat part located at a main central region thereof, and a first wrinkling part surrounding the first flat part. The first wrinkling part has a wavy cross section, which enables the front membrane 1351 to have a greater vibrating amplitude. One of the extending parts 1331 of the coil support 133 abuts against the first flat part, and is located at a different side of the first flat part from the first dome 137.

The supporting assembly 1353 may have a configuration similar to that of the front membrane 1351; the supporting assembly 1353 may be arranged at a different side of the coil support 133 from the front membrane 137, and be substantially symmetrical with the front membrane 1351 about the coil support 133. The supporting assembly 1353 includes a second flat part located at a main central region thereof, and a second wrinkling part surrounding the second flat part. The other one of the extending parts 1331 of the coil support 133 abuts against the second flat part, and is located at a different side of the second flat part from the second dome 139.

The extending parts 1331 can expand a contact area between the coil support 133 and the membrane module 135, as well as contact area between the coil support 133 and the supporting assembly 1353, so as to enhance a rigidity of the membrane module 135 and the supporting assembly 1353.

Furthermore, the supporting assembly 1353 may differ from the front membrane 1351 in that the second flat part includes a plurality of air holes; the plurality of air holes may be arranged in a line and are communicated with the receiving cavity of the main frame 152. The second dome 139 may further include a plurality of through holes corresponding to and aligned with the air holes of the supporting assembly respectively. The first dome 137 and the second dome 139 may have a shape and a size in accordance with that of the first flat part of the front membrane 1351 and the second flat part of the supporting assembly 1353, and can further enhance the rigidity of the front membrane 1351 and the supporting assembly 1353 and improve a sound effect of the speaker 1.

The magnetic system 11 includes a first magnet module 111 and a second magnet module 113 opposite to and apart from each other to form the magnetic gap for receiving the coil 131. In the present embodiment, the magnetic system 11 merely arranged at two opposite sides of the coil assembly, and no magnetic element is provided in the coil assembly of the vibrating system 13.

The first magnet module 111 includes two main magnets 1111 parallel to each other with opposite magnetized directions, and a secondary magnet 1113 arranged between the two main magnets 1111. The secondary magnet 1113 is parallel to the two main magnets 1111, and abuts against the two main magnets 1111 to form a one-piece magnet module. The second magnet module 113 is opposite to the first magnet module 111 and has a configuration substantially same as the first magnet module 111; that is, the second magnet module 113 also includes two main magnets 1111 with opposite magnetized directions, and a secondary magnet 1113 arranged between the two main magnets 1111.

The two main magnets 1111 of the first magnet module 111 are respectively parallel to and aligned with the two main magnets 1111 of the second magnet module 111 to form the magnetic gap, and the secondary magnet 1113 of the first magnet module 111 is also parallel to and aligned with the secondary magnet 1113 of the second magnet module 113.

Moreover, at least one of the first magnet module 111 and the second magnet module 113 further includes a soft magnet unit 1115, the soft magnet unit 1115 is arranged adjacent to the magnetic gap and face the coil 133 of the vibrating system 13; for example, the soft magnet unit 1115 may be attached on a surface of the at least one of the first magnet module 111 and the second magnet module 113.

In the present embodiment, a pair of soft magnet units 1115 is provided in the magnetic system 11, which is defined as a first soft magnet unit and a second soft magnet unit. The first soft magnet unit is attached on a bottom surface of the first magnet module 111, and faces the second magnet module 113; the second soft magnet unit is attached on a top surface of the second magnet module 115, and faces the first magnet module 111. As such, the first soft magnet unit and the second soft magnet unit are respectively arranged at two opposite sides of the magnetic gap, and are aligned with each other.

Furthermore, each of the pair of soft magnet units 1115 may include two separate soft magnets parallel to each other. The two soft magnets of the first magnet unit are attached on bottom surfaces of the two main magnets 1111 of the first magnet module 111 respectively, and the two soft magnets of the second magnet unit are attached on bottom surfaces of the two main magnets of the second magnet module 113 respectively.

In the present embodiment, the soft magnet units 1115 are provided in the magnetic system 111 to converge an internal magnetic field thereof, such that magnetic induction intensity of the magnetic system 111 can be well-distributed. This can improve a BL relation of the speaker 1 and ensure a linearity of the magnetic system 11, and therefore, an acoustic performance of the speaker 1 is improved. In addition, due to the soft magnet units 1115, thicknesses of the main magnets 1111 of the first magnet module 111 and the second magnet module 113 can be reduced, this can further meet a miniaturization requirement of the speaker 1.

It should be noted that the above description is merely one of optional configurations of the magnetic system 11; in other embodiments, the magnetic system 11 can be modified as necessary. For example, the first magnet module 111 may be a single main magnet, and the second magnet module 113 may be removed or replaced by a magnetic-conductive component; alternatively, each of the first magnet module 111 and the second magnet module 113 may merely include a single main magnet.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a shell including a main frame with a front opening and a rear opening, a front cover, a rear cover, the front cover and the rear cover engaged with the main frame for covering the front opening and the rear opening;

a magnetic system received in the main frame, and comprising a first magnet module and a second magnet module opposite to and apart from first magnet module for forming a magnetic gap; and a vibrating system received in the shell, and comprising a membrane module and a coil assembly for driving the membrane module to vibrate, the membrane module vibrating in a direction along an elongated axis of the main frame;

wherein the coil assembly comprises an oblate coil arranged in the magnetic gap and a coil support for supporting the coil;

the coil is located in a plane perpendicular to a plane where the membrane module is located;

the first magnet module comprises a pair of first soft magnet units;

each of the first magnet module and the second magnet module further comprise two main magnets parallel to each other and a secondary magnet located between the two main magnets;

the two main magnets of the first magnet module are respectively parallel to the main magnets of the second magnet module;

the pair of first soft magnet units are arranged corresponding to the two main magnets of the first magnet module and adjacent to the magnetic gap and face the coil;

the first magnet module and the second magnet module are separated from and opposite to each other in a direction perpendicular to the plane where the coil is located.

2. The speaker of claim 1, wherein the second magnet module comprises a pair of second soft magnet units are attached to the two main magnets of the second magnet module and adjacent to the magnetic gap; the two first soft magnet units and the two second soft magnet units are respectively arranged at two opposite sides of the magnetic gap and aligned with each other; the coil is located between the pair of first soft magnet units and the two second soft magnet units.

3. The speaker of claim 1, wherein the coil support comprises a main body for supporting the coil and a pair of extending parts bending from two opposite ends of the main body in a direction perpendicular to a plane where the main body located.

4. The speaker of claim 3, wherein the membrane module comprises a front membrane, and the vibrating system further comprises a supporting assembly, the front membrane and the supporting assembly are respectively located at two opposite sides of the coil assembly, and the pair of extending parts of the coil support is connected to the front membrane and the supporting assembly respectively.

5. The speaker of claim 4, wherein the front membrane comprises a first flat part and a first wrinkling part surrounding the first flat part, one of the extending parts of the coil support abuts against the first flat part of the front membrane.

6. The speaker of claim 5, wherein the supporting assembly comprises a second flat part and a second wrinkling part surrounding the second flat part, the other one of the extending parts of the coil support abuts against the second flat part of the supporting assembly.

7. The speaker of claim 6, wherein the vibrating system further comprises a first dome attached on the first flat part of the front membrane, and a second dome attached on the second flat part of the supporting assembly.

8. The speaker of claim 7, wherein the supporting assembly further comprises a plurality of air holes formed at the second flat part thereof, and the second dome comprise a plurality of through holes aligned with the air holes of the supporting assembly.

9. The speaker of claim 4, wherein the front membrane and the supporting assembly are respectively arranged at the front opening and the rear opening of the main frame.

10. The speaker of claim 9, wherein the shell further comprises a top cover plate and a bottom cover plate for covering the top opening and the bottom opening respectively.

11. The speaker of claim 10, wherein the top cover plate and the bottom cover plate are detachable from the main frame.

* * * * *